United States Patent [19]

Brooks

[11] Patent Number: 4,682,163

[45] Date of Patent: Jul. 21, 1987

[54] METHOD FOR WRITING CHARACTERS ON A LIQUID CRYSTAL DISPLAY

[75] Inventor: Forrest E. Brooks, Tempe, Ariz.

[73] Assignee: ITT Corporation, New York, N.Y.

[21] Appl. No.: 697,189

[22] Filed: Feb. 1, 1985

[51] Int. Cl.[4] ..... G09G 3/00

[52] U.S. Cl. ..... 340/805; 340/784

[58] Field of Search ..... 340/718, 756, 784, 792, 340/802, 805, 731, 717

[56] References Cited

U.S. PATENT DOCUMENTS

| | | | |
|---|---|---|---|
| 3,614,771 | 10/1971 | Band | 340/756 |
| 3,623,069 | 11/1971 | Malden | 340/717 |
| 3,641,558 | 2/1972 | Cook et al. | 340/717 |
| 3,641,559 | 2/1972 | Hogan et al. | 340/717 |
| 4,142,182 | 2/1979 | Kmetz | 340/765 |
| 4,281,324 | 7/1981 | Nonomura et al. | 340/784 |
| 4,335,936 | 6/1982 | Nonomura et al. | 340/784 X |
| 4,356,483 | 10/1982 | Fujita et al. | 340/805 |
| 4,386,351 | 5/1983 | Lowdenslager | 340/792 X |
| 4,547,773 | 10/1985 | Clark | 340/805 X |

*Primary Examiner*—Marshall M. Curtis
*Assistant Examiner*—Vincent P. Kovalick
*Attorney, Agent, or Firm*—T. L. Peterson; J. M. May

[57] ABSTRACT

A method for increasing the speed at which characters may be written onto a liquid crystal display of the type in which a plurality of write cycles must be applied to each picture element that is to become visible. The character writing operation is divided into two or more stages each of which preferably includes an equal number of write cycles. During at least those times when an operator is entering characters more rapidly than they can be fully written, the different stages of the writing operations for two or more successive characters are performed simultaneously to increase the apparent writing speed of the display.

13 Claims, 6 Drawing Figures

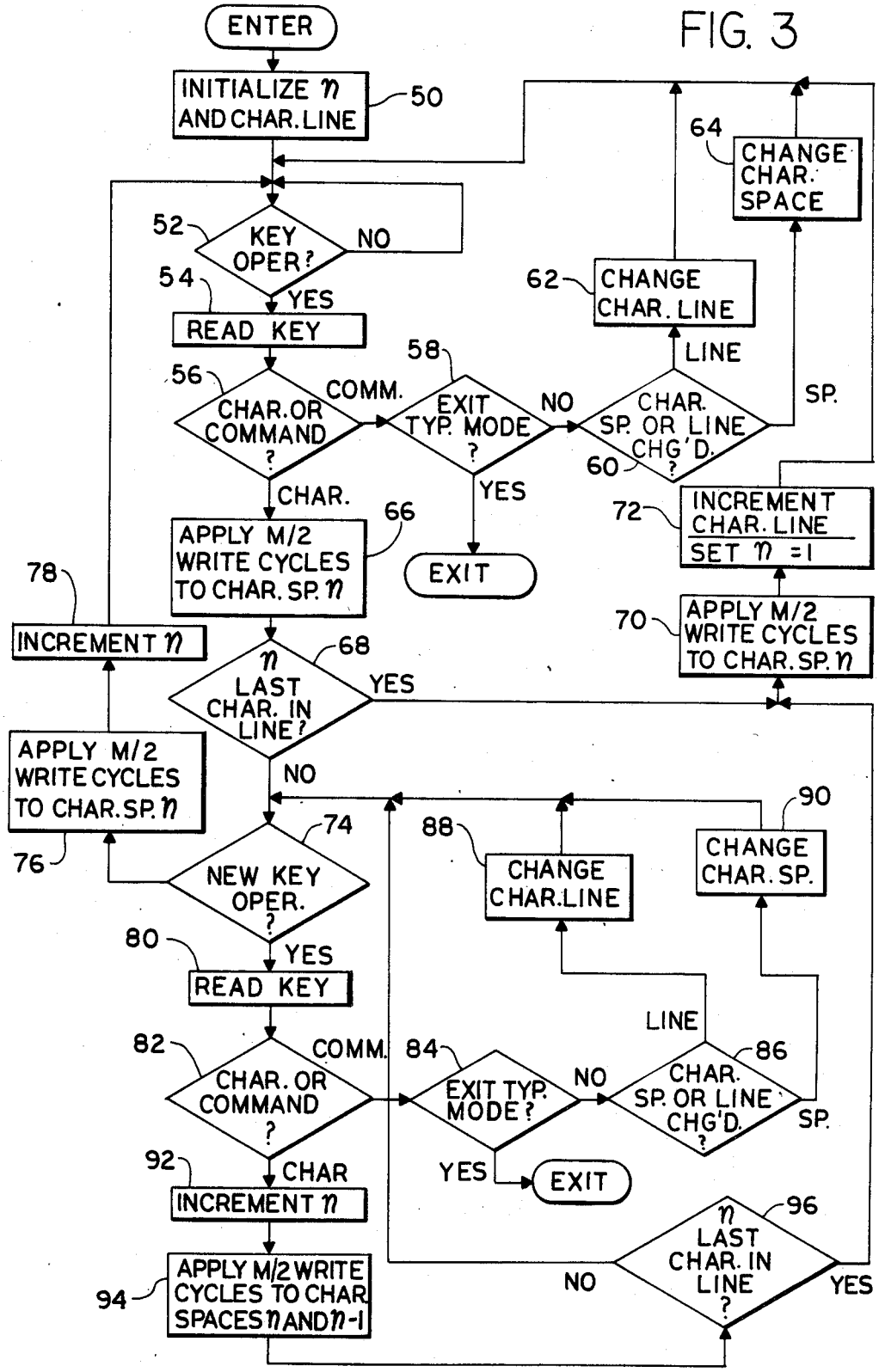
FIG. 3
ENTER
INITIALIZE n AND CHAR. LINE
50
KEY OPER?
52
NO
YES
54
READ KEY
56
CHAR. OR COMMAND ?
COMM.
CHAR.
58
EXIT TYP. MODE ?
NO
YES
EXIT
CHAR. SP. OR LINE CHG'D. ?
60
LINE
SP.
62
CHANGE CHAR. LINE
64
CHANGE CHAR. SPACE
72
INCREMENT CHAR. LINE
SET n = 1
70
APPLY M/2 WRITE CYCLES TO CHAR. SP. n
66
APPLY M/2 WRITE CYCLES TO CHAR. SP. n
78
INCREMENT n
68
n LAST CHAR. IN LINE?
YES
NO
APPLY M/2 WRITE CYCLES TO CHAR. SP. n
76
74
NEW KEY OPER. ?
YES
80
READ KEY
82
CHAR. OR COMMAND ?
COMM.
CHAR
84
EXIT TYP. MODE ?
NO
YES
EXIT
86
CHAR. SP. OR LINE CHG'D. ?
LINE
SP.
88
CHANGE CHAR. LINE
90
CHANGE CHAR. SP.
92
INCREMENT n
94
APPLY M/2 WRITE CYCLES TO CHAR SPACES n AND n-1
96
n LAST CHAR. IN LINE ?
NO
YES

METHOD FOR WRITING CHARACTERS ON A LIQUID CRYSTAL DISPLAY

BACKGROUND OF THE INVENTION

The present invention relates to liquid crystal displays and is directed more particularly to a method for increasing the apparent speed at which characters may be written on such displays.

Because of their thinness and low energy consumption, liquid crystal displays are frequently substituted for cathode ray tube displays in computerized data entry and display terminals. This substitution is occurring in spite of the fact that liqiud crystal displays which display both graphics and characters must use matrix addressing circuits to drive a plurality of individually addressable row and column conductors. Such addressing circuits have the disadvantage that they write characters only relatively slowly. One reason for this slow writing speed is the large number of picture elements or pixels which must be addressed in order to write a character. Another is the relatively long time time is required to change the optical properties of the liquid crystal material that is associated with each pixel. This slow writing speed is particularly apparent in electrically addressed displays that use liquid crystal materials which exhibit a storage characteristic. This is because each pixel of such displays may have to receive as many as 12 cycles of a suitable writing voltage before it becomes visible to a human observer.

When displays of the above type are used to display characters that are being typed on a keyboard by a fast operator, the rate at which the display can write characters will often be exceeded by the rate at which the operator can type characters. Assuming, for example, that the display requires 150 milliseconds to write a character, and that the operator is typing characters at an 8 character per second rate, the displayed characters will fall beyond the typed characters by 25 milliseconds for each character that is typed. Under such conditions, the display may still be writing the middle portion of a line when the operator has reached the end of that line. Because of such delays, an operator who wishes to check the correctness of an entry can be required to waste time waiting for the displayed characters to catch up with the typed characters. Even larger delays can occur when the characters being displayed are being received via a low speed modem.

Prior to the present invention, efforts to eliminate the above described delays have focused on the use of liquid crystal materials that can change state rapidly enough to allow characters to be written at the desired rate. Known liquid crystals materials that can change states rapidly enough must, however, be periodically rewritten or refreshed. This is because such liquid crystal materials do not exhibit a storage characteristic that allows them to remain continuously visible. As a result, terminals that used fast-responding liquid crystal materials had to either divert a part of the processing resources of the terminal from other processing tasks or be provided with special refresh circuitry.

SUMMARY OF THE INVENTION

In accordance with the present invention, there is provided an improved method for writing characters on a liquid crystal display which greatly increases the apparent speed at which characters may be written and thereby substantially eliminates delays in the presentation of character information.

Generally speaking, the present invention contemplates the division of the character writing process into two or more stages and the simultaneous performance of different stages of at least two successive characters. More particularly, the present invention divides the character writing process for at least some characters into two or more stages and carries out the first stage of the writing process for a later entered character at the same time that it carries out a later stage in the writing process for at least one earlier entered character. In this manner, displays using the method of the present invention are able to reduce the apparent time necessary to write a character by a factor equal to a number of different stages into which the character writing process has been divided.

In the preferred embodiment the method of the present invention is practiced by a computer or programmable CRT controller that has been programmed to divide the character writing process into two or more stages and to assure that no operator initiated action will cause the computer to regard a character as having been fully written until all stages of the writing process for that character have been completed. This programming assures that all stages of the writing process for each character will be completed without regard to whether characters are entered at the middle of a line or at the end of a line, are entered rapidly or slowly, or are separated by commands such as carriage returns or spaces. The method of the present invention may, however, also be practiced by appropriate hard-wired circuitry, such as dedicated LSI logic.

DESCRIPTION OF THE DRAWINGS

Other objects and advantages of the present invention will be apparent from the following description and drawings in which:

FIG. 3 is a flow chart which illustrates one embodiment of the method of the present invention;

DESCRIPTION OF THE PREFERRED EMBODIMENTS

Figure 1:
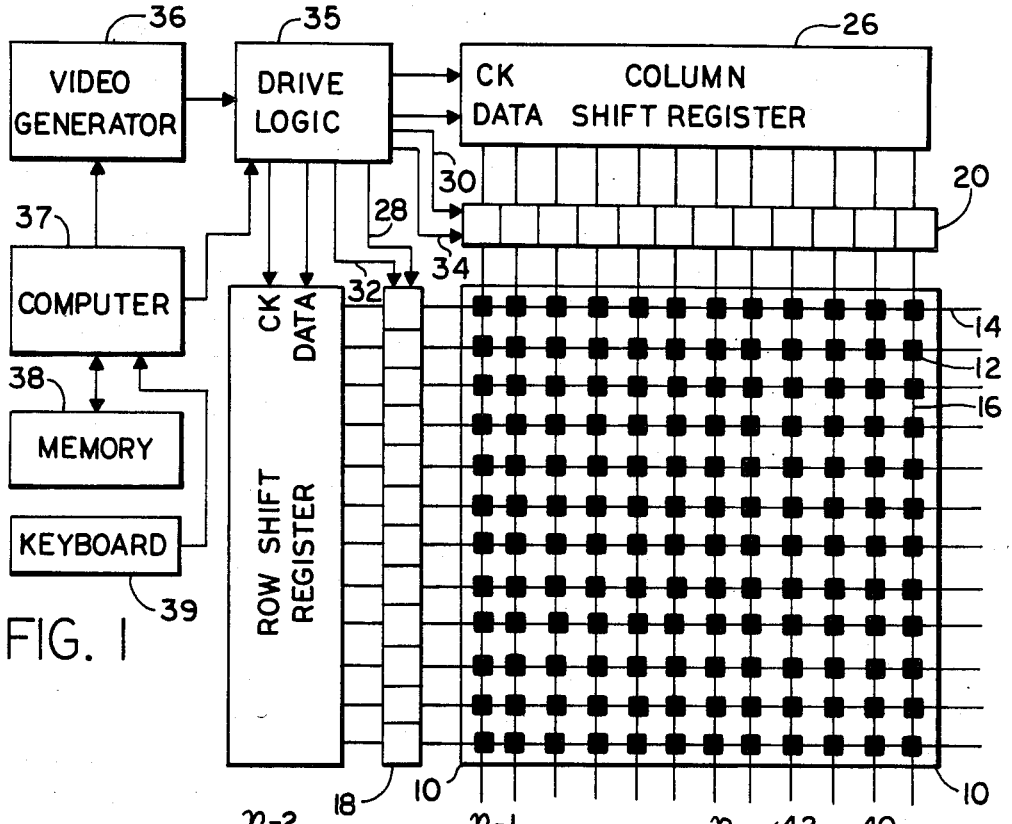
FIG. 1 is a block diagram of a matrix addressed liquid crystal display of a type that is suitable for use in practicing the method of the present invention.

Referring to FIG. 1 there is shown a simplified block diagram of one display system of a type that is suitable for use in practicing the method of the present invention. This display system includes a display panel 10 for displaying an array of picture elements or pixels 12 which are arranged in rows and columns. Each of these pixels corresponds to the intersection of an associated row conductor, such as 14, and an associated column conductor, such as 16. These conductors preferably comprise transparent strips of a conductive material, such as indium-tin oxide, which are deposited on facing surfaces of parallel sheets of glass which define the front and rear plates of the display panel. The space between these plates is filled by a suitable liquid crystal material the optical state of which may be controlled by controlling the voltages that are applied to the row and column conductors. While only 12 row conductors and 12 column conductors are shown in FIG. 1, it will be understood that the actual number of row and column conductors included in a typical display will be very much larger than 12.

The voltages of row conductors 14 of FIG. 1 are controlled by a plurality of respective row driver circuits 18. Each of these driver circuits serves to apply to the respective row conductor one of two square wave voltages, one voltage being associated with the writing of the pixels of that row and the other being associated with the erasure of the pixels of that row. Each driver circuit is also adapted to apply ground to a row conductor when the cells of that row are being neither written nor erased. Similarly, the voltages of column conductors 16 of FIG. 1 are controlled by a plurality of respective column driver circuits 20. These driver circuits also apply to the respective conductors one of two square wave voltages, one voltage being associated with the writing of the pixels of that column, and the other being associated with the erasure of the pixels of that column.

In the preferred embodiment, the liquid crystal material that is used comprises a smectic A material which has a positive dielectric anisotropy, such as 4-cyano-4'-n-octylbiphenyl, having a thickness of approximately 20 microns. Liquid crystal materials of the latter type are desirable because they have optical states which can be controlled by purely electrical means. In a first, scattered state the molecules of this material assume an irregular configuration which causes light passing therethrough to be scattered. During the establishment of the scattering state, the scattering effect is produced by the turbulent motion of the molecules that is caused by the presence of scattering voltages between the associated row and column conductors. Even after the latter voltages are removed, however, the scattering state is maintained as the liquid crystal molecules settle into a static configuration that is characterized by what are referred to as small focal-conic molecular domains. In a second, clear state the molecules of this liquid crystal material align themselves in a linear configuration which allows light to pass therethrough without being scattered. During the establishment of the clear state, the clearing effect is produced by the alignment of the molecules that is produced by the presence of clearing voltages between the row and column conductors. Even after the latter voltages are removed, however, the clear state is maintained by the molecules themselves unless and until suitable scattering voltages are applied between the associated row and column conductors.

If the above mentioned liquid crystal material and layer thickness is utilized, the scattering state of a pixel may be established by applying to the associated row and column conductors one cycle of a 25 Hz voltage having a magnitude of ±280 volts. This may, for example, be accomplished by causing the row drivers 18 to apply a ±140 volt voltage to the row conductors and by simultaneously causing column drivers 20 to apply ±140 volts to the column conductors. Ordinarily, the scattering condition is established on a row-at-a-time basis, i.e., is established for all pixels of a given row. Each such row may be scattered without scattering the pixels of adjacent rows by causing the row and column voltages to be 180° out-of-phase for pixels of the row which is to be scattered and to be in-phase for pixels of rows which are not to be scattered.

The clear state of a pixel, on the other hand, may be established by applying to the associated row and column conductors 12 cycles of a 1.5 kHz voltage of ±150 volts. This may be accomplished on a row-at-a-time basis by causing row drivers 18 to apply ±100 volts to the entire row and simultaneously causing column drivers 20 to apply ±50 volts to the respective column conductors. In such cases the pixels which will be cleared are those for which a ±180° out-of-phase relationship exists between the associated row and column conductors, while these not cleared are those for which an in-phase relationship exists between the associated row and column conductors. These phase relationships are preferably determined exclusively by the column drivers.

It will therefore be seen that the writing or clearing of a particular pixel may require the application thereto of as many as 12 cycles of a suitable write voltage. Naturally, the number of write cycles that is necessary may be greater or less than 12, depending upon the material and the frequencies and voltages that are used.

When display 10 is operating in a graphic display mode, or in a mode in which all of the characters of a line are available at the same time, the desired information may be written on the display on the above described row-at-a-time basis. For operation in this mode, data indicating whether in-phase or out-of-phase voltage relationships are to be established on the column conductors of the row to be written is supplied by a column shift register 26 into which the desired column data has been shifted. Similarly, data indicating the row that is to be written is supplied to row drivers 18 from a row shift register 24 into which the desired row data has been shifted. All selected pixels of that row are then written simultaneously by applying enable signals to the row and column drivers via conductors 28 and 30 and by applying suitable scatter/clear selecting voltages to the row and column drivers via conductors 32 and 34. All of the latter signals are supplied to the row and column drivers by a suitable drive logic circuit 35 and video generator circuit 36 under the control of a computer 37. Computer 37, in turn, determines the image that is to be displayed on the current row with reference to a suitable memory 38 in which data for each row of that image is stored. Because the nature of circuitry suitable for use as drive logic network 35, video generator 36, computer 37 and memory 38 is known to those skilled in the art, it will not be shown or described in detail herein, particularly since that circuitry is not necessary to an understanding of the present invention.

When the data to be written on display 10 is entered into computer 37 via keyboard 39, rather than read from memory 38, display 10 must be written on a character-by-character basis rather than on the above described row-at-a-time basis. This is because keyboard characters are necessarily typed on a sequential basis, and because it is customary to display characters at substantially the same time that they are keyed. Character-by-character writing, in turn, requires that column shift register 26 be cyclically loaded with data that is associated with particular horizontal slices of the character to be displayed. The manner in which character-by-character writing is accomplished is most easily understood with reference to FIG. 2.

Figure 2:
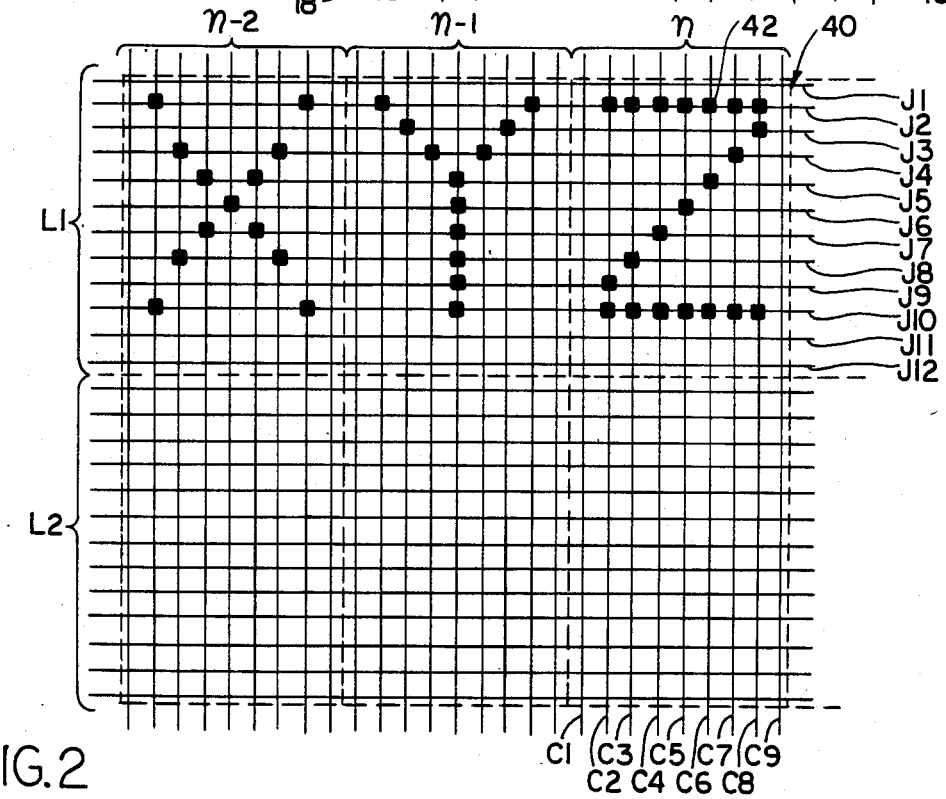
FIG. 2 is an enlarged fragmentary view of a portion of the display of FIG. 1.

In FIG. 2 there is shown in simplified form the row and column conductors that are associated with three horizontally adjacent character spaces n, n−1 and n−2 and two vertically adjacent lines of characters L1 and L2. Each of these character spaces is defined by the intersections of 12 row conductors and 9 column conductors. Character space 40, for example, is defined by the intersections of 12 rows J1 through J12 and 9 column conductors C1 through C9 and therefore includes a total of 9×12 or 108 pixels such as 42. Because these pixels are used to form characters, they may also be referred to as character elements. Under ordinary conditions the upper and lowermost rows J1 and J11-12 and the left and rightmost columns C1 and C9 of the character spaces are left blank in order to form vertical and horizontal spaces between characters. A total of 7×9 or 63 character elements are therefore available within each character space to form letters such as the illustrated X, Y and Z.

Prior to the present invention, when characters were being written on a character-by- character basis, it was customary to condition the entire line such as L1 to be written by applying scattering voltages to all of the rows within that line, and then write the desired characters by sequentially applying the necessary pattern of writing voltages to the character elements within each horizontal character space on a row-by-row basis. In order to write the character Z in character space 40, for example, it was necessary to apply 12 write cycles to the to-be-displayed character elements (C2-C8) of row J2, then apply 12 cycles of the write voltage to the to-be-displayed character elements (C8) of row J3 and so on until each horizontal slice of the character Z was written. This process was then repeated for each other character space of the line that is to contain a character, and for each other character of each other line. It will therefore be seen that when characters were being written on a character-by-character basis, the writing of a character was begun only after the completion of the writing of each earlier entered character.

When the display is operating in the above described manner, it is apparent that the writing of each character requires, at a minimum, 12 sets of 12 cycles of the 1500 Hz writing voltage (96 milliseconds) plus the time necessary for the various horizontal slices of the character to be shifted through column shift register 26, plus the time necessary for the row select bit to be shifted through row shift register 24. Together these times can add up to more than 150 msec per character, a writing speed which is less than the 125 msec per character typing speed of a fast operator. As a result, it was possible for a considerable time delay to arise between the entry of a character and its appearance on the display.

In accordance with the method of the present invention, the above mentioned delay is eliminated by dividing the character writing process into a plurality of stages and by overlapping or interleaving these stages so that groups of two or more adjacent characters can effectively be written simultaneously. The 12 write cycles necessary to fully write each element of the letter X into character space n−2 of FIG. 2, for example, may be divided into two stages each including 6 write cycles. The 6 cycles of the first stage of the writing of the X are applied when the X is entered on the keyboard. 125 ms later, when the Y is entered, the 6 write cycles of the first stage of the writing of the Y are applied at the same time as the 6 write cycles of the second stage of the writing of the X. Still later, when the letter Z is entered, the 6 write cycles of the first stage of the writing of the Z are applied at the same time as the 6 write cycles of the second stage of the writing of the Y. This multi-staged writing process is repeated as necessary as still later characters are entered. It will therefore be seen that the writing process of the invention causes each character to receive the total number of write cycles necessary to fully write the same, but causes half of those write cycles to be applied at times when other characters are being written. As a result, the apparent writing speed of the display is effectively doubled, thereby eliminating the above mentioned delay.

More generally, the writing process for each character may be divided into any desired number of stages which is less than the total number of write cycles M that is necessary to fully write one character element. If, for example, M=12 and the writing process is divided into 3 stages, each stage will include 4 write cycles. Each character will then be written in 3 stages, with the first stage occurring at the time the character is entered, the second stage occurring at the same time as the first stage of the writing of the next entered character, and the third stage occurring at the same time as the first stage of the writing of a still later entered character. Thus, the subdivision of the writing process into a plurality of overlapped stages causes apparent writing speed of the display to be increased by a factor approximately equal to the number of stages.

Figure 4:
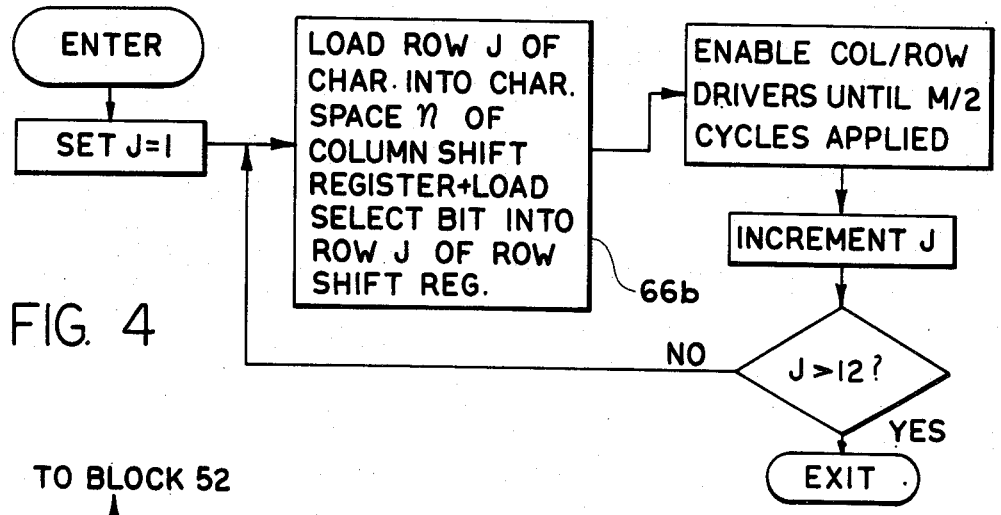
FIG. 4 is a flow chart which illustrates the steps that may be included in one of the blocks shown in FIG. 3.

In practicing the just described method, it is desireable to assure that the writing of each character is completed under each of the possible conditions that can arise during the operation of the terminal in the keyboard entry mode. It is necessary, for example, that each character be fully written when it is the last (or only) character on a line, when one or more spaces are inserted between characters and when keyboard commands such as carriage returns are entered. The manner in which the present invention takes these conditions into account will now be described with reference to FIGS. 3 and 4.

Referring to FIG. 3 there is shown a simplified flow chart that illustrates one representative embodiment of a program which is suitable for use in practicing the present invention. Operation in accordance with the invention begins when the operator causes the terminal to operate in the keyboard entry or typing mode. As this occurs, the computer encounters a block 50 which causes it to initialize the character position, i.e., select the position at which the first character will be displayed. Usually, but not necessarily, this initialization will cause the first character to be entered in the first character space (n=1) of the first or uppermost character line of the display.

After initialization, the computer is directed to a decision block 52 which causes it to recurrently test for the depression of a key. When a key has been depressed, the program reads the same (block 54) and then determines (block 56) whether the key indicates the entry of a character or of a command. If the key indicates a command, the computer determines (block 58) whether operation in the typing mode is to be terminated, and, if not, whether (block 60) the operator wishes to change either the character space or the character line at which the next entered character is to displayed. Any necessary changes in the character line or space are then executed via blocks 62 and 64 before the computer is directed back to block 52.

After the operator has reached the desired character position, he will begin to enter characters, thereby causing decision block 56 to direct the computer to a block 66. The latter block causes the computer to carry out one stage of the character writing process by applying to the pixels which form the desired character a fraction, in this example one-half, of the total number of write cycles M that must be applied thereto in order to fully write the desired character. This number of write cycles is then successively applied to the pixels of each row of the character by executing a suitable sub-routine such as that shown in FIG. 4. This sub-routine comprises a write loop which is repeatedly executed under the control of a loop counter J having a maximum value which is equal to the maximum number of rows on which must be written in order to display a character. Because the operation of this loop is self-explanatory, it will not be described in detail herein.

After the first stage of the writing process has been completed, i.e., after the character has been partially written, the computer is directed to a decision block 68 which causes it to determine whether the just entered character is the last character to be displayed on its line. If it is, the program is directed to a block 70 (that is the same as block 66) which causes it to immediately initiate the second stage of the character writing process by applying the remaining one-half of the write cycles to the pixels that form the desired character and thereby completing the writing thereof. Once this has been accomplished, the computer is directed to a block 72 which causes it to increment the character line and initialize character space counter n. The effect of this block is to direct the next entered character to the first character space of the next line of the display and to return the computer to block 52 to await the depression of the next key. It will therefore be seen that, even if the operator enters only a single character on a line, that character will be fully written as a result of the performance of both stages of the two stage writing process therefor.

If the character which was partially written by the execution of block 66 is not the last character on its line, the computer is directed to a decision block 74 which causes it to determine whether another key has been depressed.

(a) If it has not, the computer is directed to block 76 (that is the same as block 66) which causes it to immediately initiate the second stage of the writing process for the first entered character. When this has been accomplished, the computer increments the value of n (block 78) and returns to decision block 52 to await the entry of a new character or command.

(b) If it has, the key is immediately read (block 80) and, if it indicates the entry of a command, is processed via blocks 84 through 90 which are analogous to previously described blocks 58 through 64. If the key indicates the entry of a character, however, the computer is directed to a block 92 which increments the value of character space counter n and to a block 94 which initiates both the first stage of the writing process for the just entered character (n) and the second stage of the writing process for the preceeding character (n−1). This two character writing process is accomplished by the execution of a program segment which is the same as that shown in FIG. 4, except that loading block 66*b* thereof loads character data both for the just entered character (n) and for the preceeding character (n−1). When this program segment has been executed, just entered character (n) will be partially written and the preceeding character (n−1) will be fully written.

After the computer exits block 94, it proceeds to a decision block 96 which causes it to determine whether the just entered character is the last character on its line. If it is, the computer is directed to previously described blocks 70 and 72 which cause it to execute the second stage of the writing process for the just entered character before proceeding to the next line of the display. If the just entered character is not the last character on its line, the computer is directed back to block 74 to determine if a new character has been entered.

(a) If it has, the computer is directed to blocks 80 through 94 and executes the first stage of the writing process for that new character and the second stage of the writing process for the preceeding character.

(b) If it has not, the computer is directed to block 76 and immediately initiates the second stage of the writing process for the last entered character.

In view of the foregoing, it will be seen that, under circumstances in which characters are being entered in rapid succession by a fast operator, the loop including blocks 74, 80, 82, and 92 through 96 will be executed repeatedly until either the last character in a line is entered, causing a diversion to block 70, or there is an interruption in the character flow, causing a diversion to block 76. Since all of these possibilities cause the computer to complete the writing of any then partially written characters, it follows that there is no operator initiated action which will leave any partially written characters. Stated differently, the present invention reconciles the requirements of a multi-stage writing process with the requirement that an operator be free to enter data or commands in any order.

Ordinarily, an operator will not command the terminal to exit from the typing mode within only a fraction of a second after having entered a new character. It will not, therefore, ordinarily be necessary for a write block, such as block 66, to be present between decision blocks 58 and 84 and exit blocks 95 and 97, respectively. Writing blocks may nevertheless be inserted between the last mentioned pairs of blocks as a precaution.

As explained previously, the method of the present invention is not restricted as to the number of stages into which the writing process may be divided. If, for example, the writing of each character is divided into three stages, a total of M/3 write cycles should be applied to each of the pixels which form the desired character during each of the three stages of the writing process therefor. An example of how the flow chart of FIG. 3 might be modified to accommodate three or more stages is shown in the fragmentary flow chart of FIG. 5B.

Figure 5A:
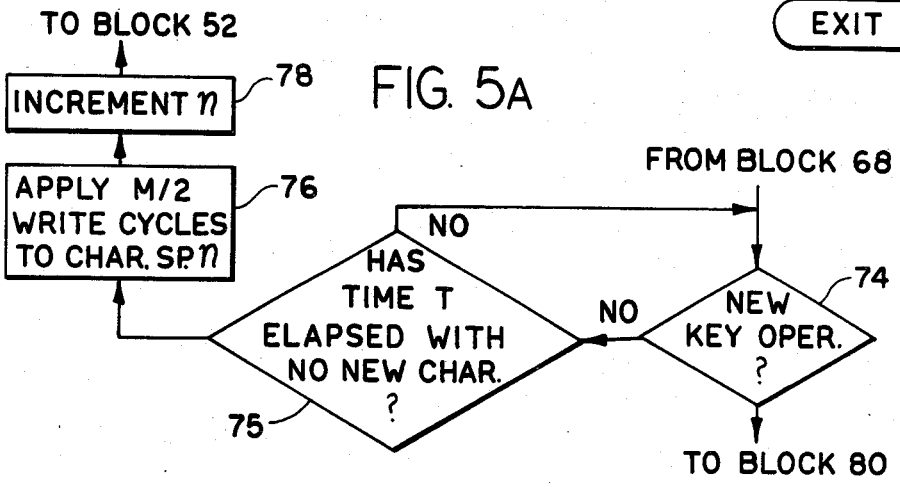
FIGS. 5*a* and 5*b* are fragmentary flow charts which illustrate alternative embodiments of selected parts of the flow chart of FIG. 3.
Figure 5B:
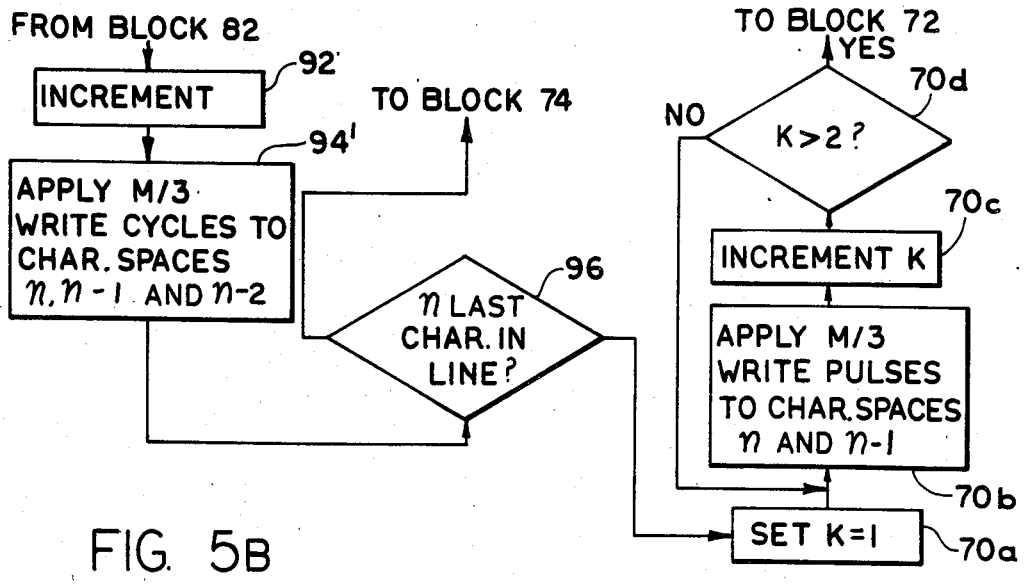

In FIG. 5B there is shown a segment of a flow chart which may be substituted for blocks 92, 94, 96 and 70 of FIG. 3 in order to provide for a three stage writing process. The operation of the flow chart which results from this substitution is similar to that of the flow chart of FIG. 3, except in two respects. Firstly, write block 94′ of FIG. 5B partially writes not only the current character (n) and the immediately preceeding character (n−1), but also still earlier character (n−2), and thereby assures that different stages of three different characters are all written at the same time. This three-stage partial writing is accomplished by a write loop which is similar to that shown in FIG. 4, except that the load block (66*b*) thereof loads three rather than two character slices at a time.

Secondly, the flow chart of FIG. 5B includes a multi-block write loop, comprising blocks 70*a* through 70*d*, in place of write block 70 of FIG. 3. This write loop, which is controlled by a loop counter K, assures that the computer completes the writing of any partially written characters at the end of a line before proceeding to a new line. It will be understood that a similar multi-block write loop should be substituted for block 76 of FIG. 3 in order to fully adapt the flow chart of FIG. 3 to write characters in three stages.

In principle, the number of stages into which the writing process can be divided can be as high as the number of write cycles that are necessary to fully write a character. If the previously mentioned liquid crystal material is used, this number will ordinarily be relatively small, e.g., 2 or 3. If other, slower responding liquid crystal materials are used, however, higher numbers of stages may be necessary in order to eliminate writing delays. In addition, if characters are being received from a serial source, such as a modem, that can output character faster than even the fastest typist, a relatively high number of stages such as six or more may be desireable with even a relatively fast responding liquid crystal material. It will be understood that the method of the present invention is not limited to any particular number of stages or to any particular liquid crystal material.

Under certain conditions, the rate at which keys are pressed by the operator may be such that it is undesireable for the absence of a new key operation (block 74) to immediately initiate the completion of the writing process for an already entered character (block 76). This is because, if a new character is entered immediately after the second (or later) stage of the writing process for an earlier entered characters is begun there can be an appreciable slowdown in the apparent rate at which characters are written on the display. In order to eliminate this potential slowing of the writing speed of the display, it may be desireable to insert a new block 75 between blocks 74 and 76 of the flow chart of FIG. 3 and thereby produce a flow chart segment of the type shown in FIG. 5A. The effect of new block 74 is to introduce a brief time delay T between the determination that no key has been depressed and the initiation of the second stage of the writing process for an earlier entered character. This time delay serves to increase the speed at which characters can be displayed by, in effect, giving the computer a second chance to complete the writing of an earlier entered character at the same time as the writing of a later entered character, rather than at a different time. In practice the length of time delay T which provides the greatest increase in apparent writing speed is not critical, and may vary somewhat from operator to operator. A time delay approximately equal to one-half of the duration of one stage of the writing process, e.g., 48 msec, may therefore be adopted as a suitable compromise value. Alternatively, the duration of time delay T may be selected as a result of a statistical analysis of the times which a typical operator spends writing speeds typing at various speeds. It will be understood that all reasonable values of time delay T are within the contemplation of the present invention.

While the method of the present invention has been described with reference to a number of specific embodiments and examples, it will be understood that the true spirit and scope of the present invention should be determined only with reference to the following claims.

What is claimed is:

1. A method for increasing the speed at which characters may be written onto a liquid crystal display of the type which includes a plurality of row and column electrodes, in which the writing of each element of a character is completed by the coincident application of M cycles of a write voltage to the row and column electrodes that are associated with that element, M being an integer greater than or equal to 2, and in which the elements making up each character are grouped into a plurality of horizontal slices of that character, said method comprising the steps of:

(a) applying M/P cycles of the write voltage to the row and column electrodes that are associated with predetermined elements of successive horizontal slices of a selected character, and thereby partially completing the writing of said character, P being an integer which is smaller than M;

(b) simultaneously with step (a), successively applying M/P cycles of the write voltage to the row and column electrodes that are associated with predetermined elements of the corresponding horizontal slices of at least one previously selected character, and thereby advancing the completion of the writing of said previously selected character;

(c) repeating steps (a) and (b) for successive sets of at least two horizontally adjacent characters; and (d) discontinuing the coincident application of the write voltage to the row and column electrodes that are associated with predetermined elements of each character after M cycles of the write voltage have been applied to each of such elements.

2. The method of claim 1 in which M/P is an integer greater than 1.

3. A method for increasing the speed at which characters may be written onto a liquid crystal display, said display being of the type including a plurality of row and column electrodes, and a plurality of character spaces, each character space comprising an array of character elements that are associated with predetermined row and column electrodes, said display also being of the type in which the writing of each character element is completed by the coincident application of M cycles of a write voltage to the associated row and column electrodes, where M is an integer greater than or equal to 2, said method comprising the steps of:

(a) successively applying M/P cycles of the write voltage to predetermined character elements of each row of the character that is to be displayed in character space n and thereby partially writing that character therein, P being an integer which is smaller than M;

(b) following the completion of step (a), successively applying M/P cycles of the write voltage to predetermined character elements of each row of the character that is to be displayed in character space n'and thereby partially writing that character therein;

(c) simultaneously with step (b), successively applying a further M/P cycles of the write voltage to said predetermined character elements of each row of the character that is to be displayed in character space n and thereby continuing the writing of that character; and (d) discontinuing the coincident application of the write voltage to the row and column electrodes that are associated with said predetermined elements of each character after M cycles of the write voltage have been applied to each of such elements.

4. The method of claim 3 in which the display is used with a keyboard having a plurality of manually operable character keys, and in which n is incremented when any of said character keys is depressed.

5. The method of claim 4 in which a further M/P cycles of the write voltage are successively applied to said predetermined character elements of each row of the character that is to be displayed in character space n, within a predetermined time of the completion of step (a), if no key is depressed before the elapse of that time.

6. The method of claim 3 in which M/P is an integer greater than 1.

7. A method for increasing the speed at which characters may be written onto a multi-line liquid crystal display, said display being of the type which includes a keyboard, a plurality of row and column electrodes, a plurality of character spaces, each character space including a plurality of character elements that are associated with particular row and column electrodes and that are organized into a pluraltity of respective rows, said display also being of the type in which the writing of each character is completed by the coincident application of M cycles of a write voltage to the row and column electrodes that are associated with predetermined character elements of each row of that character, M being an integer greater than or equal to 2, said method comprising the steps of:

(a) applying M/P cycles of the write voltage to predetermined character elements of successive rows of the character that is to be displayed in character space n and thereby partially writing that character therein, P being an integer which is smaller than M; and (b) if the character to be displayed in character space n is the last character on a line, applying to said predetermined character elements of successive rows of that character sufficient additional cycles of the write voltage to complete the writing of that character before proceeding to the next line; or (c) if the character to be displayed in character space n is not the last character on said line, simultaneously applying M/P cycles of the write voltage to predetermined character elements of successive rows of at least the characters that are to be displayed in character spaces n and n+1 after the n+1st character has been entered via the keyboard; and (d) discontinuing the application of the write voltage to said predetermined character elements of each character after M cycles of the write voltage have been applied to each of such elements.

8. The method of claim 7 in which sufficient additional cycles of the write voltage are applied to said predetermined character elements of successive rows of the character that is to be displayed in at least character space n, without the simultaneous application of cycles of the write voltage to the character elements of the character that is to be displayed in character space n+1, if the n+1st character is entered more than a predetermined time after character n.

9. The method of claim 7 in which n is increased by one after each character is entered on the keyboard.

10. The method of claim 7 in which n is reset to one after all of the characters of a line have been fully written.

11. The method of claim 7 in which an operator may change the line on which characters are being written, via said keyboard, and in which all characters of a line are fully written before any characters are written on a new line.

12. The method of claim 7 in which M/P is an integer greater than 1.

13. The method of claim 1 in which the display is a multi-line display, in which steps (a) through (d) are performed successively for each character-containing line of the display and in which the writing of all of the characters of each character-containing line is completed before the writing of any character of any subsequent line is begun.

* * * * *